United States Patent [19]

Dantlgraber

[11] 4,222,714

[45] Sep. 16, 1980

[54] RADIAL PISTON PUMP

[75] Inventor: Jörg Dantlgraber, Lohr, Fed. Rep. of Germany

[73] Assignee: Rexroth GmbH, Lohr, Fed. Rep. of Germany

[21] Appl. No.: 894,017

[22] Filed: Apr. 5, 1978

[30] Foreign Application Priority Data

Apr. 16, 1977 [DE] Fed. Rep. of Germany ..... 2716890

[51] Int. Cl.[3] ..... F04B 1/04

[52] U.S. Cl. ..... 417/273; 417/DIG. 1

[58] Field of Search ..... 417/269, 273, 464; 308/DIG. 7

[56] References Cited

U.S. PATENT DOCUMENTS

| | | | |
|---|---|---|---|
| 3,059,586 | 10/1962 | Brailsford | 417/465 |
| 3,183,847 | 5/1965 | Raymond | 417/269 |
| 3,397,856 | 8/1968 | Sullivan et al. | 308/DIG. 7 |
| 3,885,459 | 5/1975 | Freese | 92/119 |
| 3,912,421 | 10/1975 | Gelin | 417/464 |
| 3,945,766 | 3/1976 | Gelon | 417/465 |

FOREIGN PATENT DOCUMENTS

| | | | |
|---|---|---|---|
| 600899 | 7/1960 | Canada | 308/DIG. 7 |
| 716871 | 8/1965 | Canada | 91/499 |
| 824940 | 12/1959 | United Kingdom | 308/DIG. 7 |
| 892350 | 1/1961 | United Kingdom | 308/DIG. 7 |

*Primary Examiner*—William L. Freeh
*Attorney, Agent, or Firm*—Michael J. Striker

[57] ABSTRACT

A radial piston pump has a housing, a shaft mounted for rotation in the housing and including an eccentric provided with a cam track, inlet and outlet ports in the housing, valve means installed in the ports, a plurality of radially reciprocable pistons spaced about the eccentric and each having a radially inner surface in sliding engagement with the cam track, and a layer of synthetic plastic material having a low coefficient of friction on each of the surfaces, so as to reduce friction between the same and the cam track.

13 Claims, 2 Drawing Figures

RADIAL PISTON PUMP

BACKGROUND OF THE INVENTION

The present invention relates to a radial piston pump. More particularly, it relates to a radial piston pump in which base portions of pistons are in sliding engagement with an eccentric of a shaft of the pump.

Radial piston pumps in which base portions of pistons are in sliding engagement with eccentric of a pump shaft have been proposed in the art. In the known radial piston pumps, the base portions of the pistons are of one piece with the latter and are constituted by the same material. Since under the action of great bearing forces this material tends to wear, the piston is to be hydraulically equalized for reducing bearing forces between the piston base portions and the eccentric. For this purpose, the piston is provided with radial passage which communicates an inner chamber of a pump housing with the piston base portion, whereas in the eccentric region of the piston base portion a recess is provided, which substantially corresponds to the contact surface of the piston. Such hydrostatic unloading of the piston with the piston base portion and corresponding reduction of the pressure exerted by the piston base portion to the eccentric requires very high manufacturing accuracy, inasmuch as otherwise a working fluid enters the region between the piston base portion and the eccentric and, in addition to increased leakage, makes the hydrostatic unloading ineffective. This results in fast wear of the contact surfaces of the eccentric and piston base portions which are movable relative to one another.

It has been also proposed to produce the piston base portions as separate members, and to make the piston base portion of a material having good bearing characteristics, such as of a bronze alloy. In this case, the piston base portion is secured to the piston by means of screws. An additional hydrostatic unloading of the pistons with the piston base portions is thereby not needed. However, this construction also requires accurate manufacture in order to reduce the sliding friction between the piston base portions and the eccentric, since otherwise cavities formed on the piston base portions and the eccentric would result in fast wear of the same. The above-mentioned known bearing of the piston base portions with the eccentric requires also very fine filtering of the oil or the working fluid, in order to halt the wear of the surfaces of the piston base portions and the eccentric sliding relative to one another, in narrow limits so as to assure a practically justified service life of the bearing.

SUMMARY OF THE INVENTION

Accordingly, it is an object of the present invention to provide a radial piston pump which avoids the disadvantages of the prior art.

More particularly, it is an object of the present invention to provide a radial piston pump whose bearing of the piston base portions on the eccentric requires small manufacturing expenditures, has a high service life and does not require fine filtering of the oil.

In keeping with these objects, and with others which will become apparent hereinafter, one feature of the present invention resides, briefly stated, in a radial piston pump having a housing, a shaft mounted for rotation in said housing and including an eccentric provided with a cam track, inlet and outlet ports in the housing, valve means installed in the ports, a plurality of radially reciprocable pistons spaced about the eccentric and each having a radially inner surface in sliding engagement with the cam track, in which pump a layer of synthetic plastic material having a low coefficient of friction is provided on each of the surfaces of the pistons, so as to reduce friction between the same and the cam track. In this construction bearing of the pistons on the eccentric requires small manufacturing expenditures, has a high service life, and does not require fine filtering of the oil.

Polytetrafluoroethylene may be utilized as the above-mentioned synthetic plastic material. The inner surface provided with the layer of this synthetic plastic material may be formed in a base portion of each of the pistons. A radially outer surface of each of the pistons may contact a radially inner surface of a respective one of valve elements provided in the valve means. The above-mentioned radially outer surfaces of the pistons may be provided in separate cylindrical members associated with the pistons.

Another feature of the present invention is that a sheet member is provided, which is secured to the base portion of each of the pistons, and the layer of the synthetic plastic material is secured to the sheet member. The sheet member may be bronze coated and secured to the base portion of the piston by means of glue.

A further feature of the present invention is that the sheet member has a thickness equal to substantially 1 millimeter.

A still further feature of the present invention is that a surface of the base portion of the piston facing toward the eccentric, and a surface of the sheet member facing toward the piston may be roughened. In this case, the facing surface of the base portion may be etched whereas the facing surface of the sheet member may be sand-blasted.

An additional feature of the present invention is that the cam track provided in the eccentric of the shaft may have a peak-to-valley height at most equal to 4 microns.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENT

Figure 1:
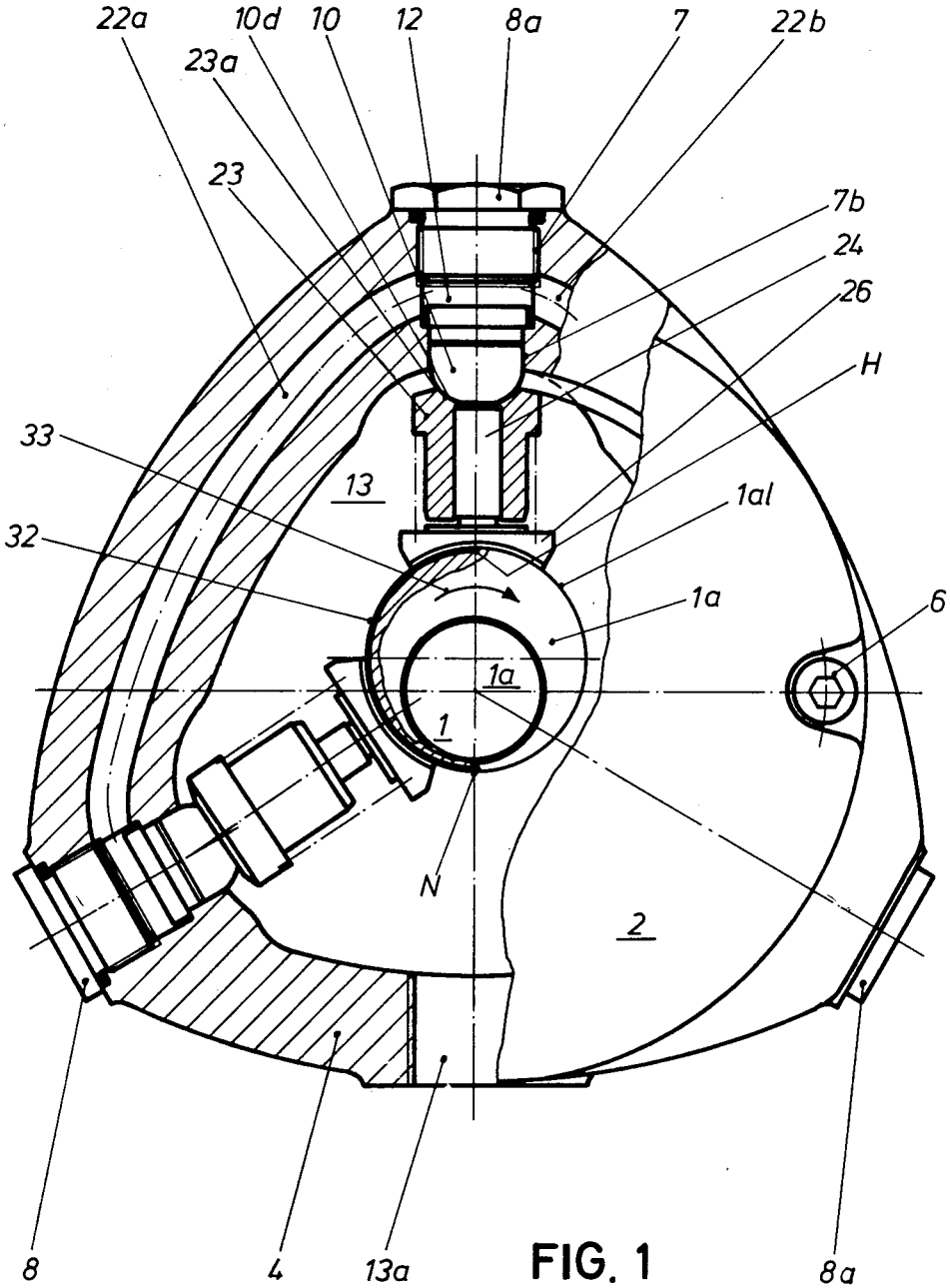
FIG. 1 is a partially sectioned plan view of a radial piston pump in accordance with the present invention.
Figure 2:
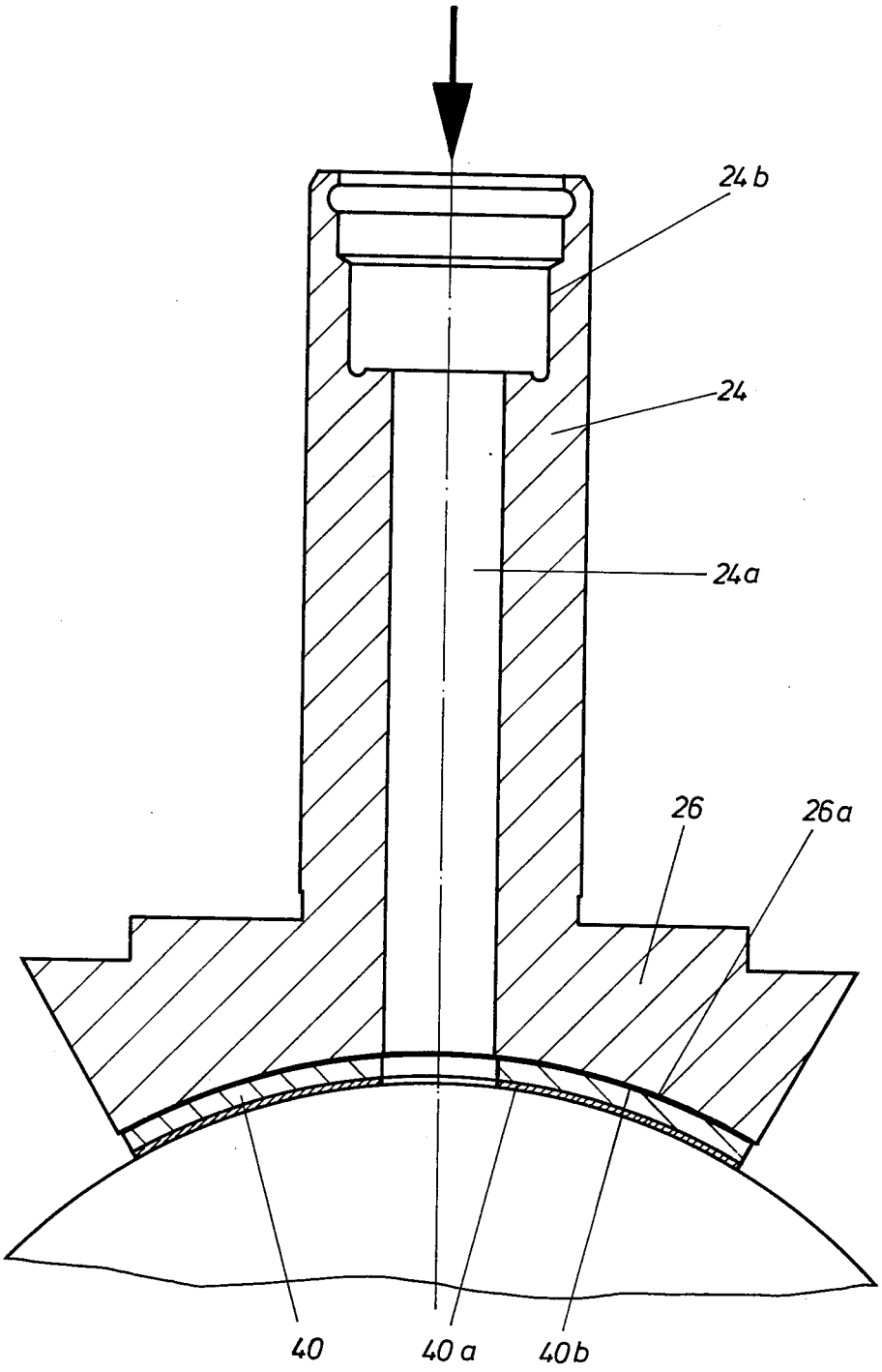
FIG. 2 is an enlarged view showing a piston with a piston base portion and an eccentric of the radial piston pump in accordance with the present invention.

FIG. 1 shows a rotary piston pump in accordance with the present invention wherein a pump shaft is identified by reference numeral 1 and has an eccentric identified by reference numeral 1*a*. Three radial bores 7 are provided in a housing 4 and uniformly distributed over a circumferential surface thereof. A plurality of pressure chambers 12 are formed between pressure valve bodies 10 and locking screws 8 or threaded sleeve members 8*a*. The threaded sleeve members 8*a* form pressure conduits. Channels 22*a* and 22*b* which are casted in the housing 4 communicate the pressure chambers 12 with one another.

The housing 4 bounds an inner chamber 13. An end portion 10*d* of each of the pressure valve bodies 10 facing toward the inner chamber 13 of the housing is ball-shaped. A cylindrical member 23 has a sealing surface 23*a* which sealingly abuts against the ball-shaped end portion 10*d* of a respective one of the pressure valve bodies 10. Therefore, the ball-shaped end portion 10*d* of the piston valve member 10 and the sealing surface 23*a* of the cylindrical member 23 together form a universal joint. Each of pistons 24 has a sliding member 26 which is in contact with a contact surface 1*a*1 of the eccentric 1*a*. The above-mentioned universal joint formed by the respective surfaces of the pressure valve bodies and the cylindrical members compensate for the manufacturing inaccuracy between the eccentric contact surface 1*a*1 and the piston sliding portion 26.

The sliding portion or a base piston 26 of each of the pistons has a surface 26*a* facing toward the eccentric, which is roughened, for instance by sand-blasting. A sheet member 40 is provided on the surface 26*a* of the piston base portion 26. A layer 40*a* of a synthetic plastic material such as polytetrafluoroethylene is provided on the sheet member 40. The sheet member 40 has a surface 40*b* facing toward the piston base portion, which surface is roughened, for instance by etching. The sheet member 40 is secured to the piston base portion 26 by means of gluing, for example by a layer of a synthetic plastic glue. The roughened surface 26*a* of the piston base portion 26 and the roughened surface 40*b* of the sheet member 40 assures durable securing of the sheet member 40 to the piston base portion 26 by means of the above-mentioned glue.

During polymerization of the synthetic plastic glue, the piston base portion 26 with the sheet member 40 are subjected to pressure and temperature. During this process a contact surface of the layer of the synthetic plastic material 40*a*, which is in operation in sliding engagement with an outer surface of the eccentric 1*a*, abuts against a jig which is shaped in correspondence with the shape of the eccentric. Therefore, exact correspondence of the contact surface of the layer of the synthetic plastic material 40*a* to the outer surfaces of the eccentric 1*a* of the shaft 1 of the pump is guaranteed. The contact surface 1*a*1 of the eccentric has the maximum peak-to-valley height equal to 4 microns, so as to provide a wearless sliding engagement between the layer of the synthetic plastic material 40*a* and the eccentric 1*a*. Slight roughness of the contact surface of the eccentric 1*a* is smoothed by slight wear of the layer of the synthetic plastic material 40*a* and thereby the contact surface 1*a*1 of the eccentric additionally assumes low friction characteristics. The layer of the synthetic plastic material constituted by polytetrafluoroethylene which is mixed in known manner with tetrafluoropropylene, guarantees that low friction sliding moment between the piston base portion and the eccentric is provided not only during hydrodynamic lubrication, but also during semi-dry start-up phase of the pump operation. The sheet member 40 which carries the synthetic plastic layer 40*a* has a thickness equal to substantially 1 millimeter, so that the sheet member can be mounted on the piston base portion without preforming and tension-free.

The piston 24 has an axial passage 24*a* which is in an operative communication with a groove 32 provided in the contact surface 1*a*1 of the eccentric and extending to the lowest reversal point, so that when the eccentric rotates between the upper dead point and the lower dead point in the direction shown by the arrow 33 a communication with the inner chamber 13 is established, which, in turn, communicates with a reservoir through an opening 33*a*. This rotation from the upper to the lower dead points of the eccentric corresponds to the suction stroke when the inner chamber of the pump is filled with working fluid through a not-shown valve located in a piston head 24*a*. During the subsequent discharge stroke of the piston when the piston is displaced in the direction of the pressure valve members 10, the communication between the axial passage 24*a* and the inner chamber 13 is interrupted. In this region of the eccentric 1*a* there is no groove, so that the entire contact surface 1*a*1 of the eccentric 1*a* is available for transmission of the operative force to the piston 24.

It will be understood that each of the elements described above, or two or more together, may also find a useful application in other types of constructions differing from the types described above.

While the invention has been illustrated and described as embodied in a radial piston pump, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A radial piston pump, comprising a housing; a shaft mounted for rotation in said housing and including an eccentric provided with a camrack; inlet and outlet ports in said housing; valve means installed in said ports; a plurality of radially reciprocable pistons spaced about said eccentric and each having a radially inner base portion with a radially inner surface facing toward said cam track; and a sheet member secured to said radially inner surface of said base portion of each of said pistons and provided with a relatively thin layer of a synthetic plastic material having a low coefficient of friction and being in sliding engagement with said cam track, said cam track of said eccentric of said shaft having a peak-to-valley height at most equal to 4$\mu$ so as to provide for optimum sliding of said cam track and said layer relative to one another and low wear of the same, said sheet member having a thickness equal to substantially 1 mm so that it is readily deformable and provides for well fitting to said radially inner surface of said base portion and securing to the latter.

2. The radial piston pump as defined in claim 1, wherein said material is polytetrafluoroethylene.

3. The radial piston pump as defined in claim 1, wherein said sheet member is bronze coated.

4. A radial piston pump as defined in claim 1, wherein said cam track has a cylindrical shape, and said sheet member is cylindrically deformed in accordance with the cylindrical shape of said cam track.

5. The radial piston pump as defined in claim 1, wherein said valve means includes valve elements each of which is located in a respective one of said ports radially outwardly relative to a respective one of said pistons, each of said valve elements has a radially inner spherical surface and each of said pistons has a radially outer surface in contact with said radially inner surface of a respective one of said valve elements.

6. The radial piston pump as defined in claim 5, wherein each of said pistons has a radially outer portion, said radially outer surface of said pistons being provided in said radially outer portions thereof.

7. The radial piston pump as defined in claim 6, wherein said radially outer portion of each of said pistons is a separate cylindrical member.

8. The radial piston pump as defined in claim 1; and further comprising means for securing said sheet member to said base portion of said piston, including a layer of glue.

9. The radial piston pump as defined in claim 1, wherein said radially inner surface of said base portion of said piston faces toward said sheet member and thereby toward said layer of glue and is rough.

10. The radial piston pump as defined in claim 9, wherein said radially inner surface of said base portion of said piston is etched.

11. The radial piston pump as defined in claim 8, wherein said sheet member had a surface facing toward said radially inner surface of said base portion of said piston and thereby toward said layer of glue, said surface of said sheet member being rough.

12. The radial piston pump as defined in claim 11, wherein said surface of said sheet member is sandblasted.

13. A radial piston pump, comprising a housing a plurality of valve piston units in said housing and each having a pressure valve element, and a reciprocable piston element radially inwardly spaced from said pressure valve element, said piston element including a piston member having a radially inner base portion, and a cylinder member associated with said piston member and having a radially outer portion, a shaft mounted for rotation in said housing and including an eccentric provided with a cam track; means forming moving engagement between cylinder members and said pressure valve elements, including a spherical surface formed in each of said pressure valve elements, and a contact surface formed in said radially outer portion of each of said cylinder members and complementary to said spherical surface of respective ones of said pressure valve elements; and means forming sliding engagement between said piston members and said cam track of said eccentric of said driving shaft, including a radially inner surface formed in said base portion of each of said piston members and provided with a sheet member secured to said radially inner surface of said base portion of each of said pistons and having a relatively thin layer of polytetrafluoroethylene adapted to slidably contact with said cam track, said cam track of said eccentric of said shaft having a peak-to-valley height at most equal to $4\mu$ so as to provide for optimum sliding of said cam track and said layer relative to one another and low wear of the same, said sheet member having a thickness equal to substantially 1 mm so that it is readily deformable and provides for well fitting to said radially inner surface of said base portion and securing to the latter.

* * * * *